United States Patent [19]

Simpson et al.

[11] Patent Number: 4,887,192

[45] Date of Patent: Dec. 12, 1989

[54] ELECTRODELESS LAMP HAVING COMPOUND RESONANT STRUCTURE

[75] Inventors: James E. Simpson, Gaithersburg; Mohammed Kamarehi, Rockville; Michael G. Ury, Bethesda, all of Md.

[73] Assignee: Fusion Systems Corporation, Rockville, Md.

[21] Appl. No.: 267,426

[22] Filed: Nov. 4, 1988

[51] Int. Cl.[4] ..... F21K 7/00

[52] U.S. Cl. ..... 362/265; 362/263; 362/297; 315/39; 315/248; 315/344

[58] Field of Search ..... 362/263, 265, 297, 346; 315/39, 248, 267, 344

[56] References Cited

U.S. PATENT DOCUMENTS 4,673,846 6/1987 Yoshizawa et al. ..... 315/248
4,683,525 7/1987 Camm ..... 362/346
4,749,915 6/1988 Lynch et al. ..... 315/248

FOREIGN PATENT DOCUMENTS 60696 4/1982 Japan .
123954 8/1985 Japan .
45665 9/1987 Japan .

*Primary Examiner*—Stephen F. Husar
*Attorney, Agent, or Firm*—Pollock, Vande Sande & Priddy

[57] ABSTRACT

An electrodeless lamp which couples to a small bulb and obtains a relatively high light output therefrom. A cavity which comprises a compound resonant structure including vestibule and reflector portions is provided. The combination of vestibule and reflector results in a condition of resonance throughout the cavity, whereby strong fields are coupled to the small bulb and a reflector is provided for directing and enhancing light output.

24 Claims, 4 Drawing Sheets

ELECTRODELESS LAMP HAVING COMPOUND RESONANT STRUCTURE

The present invention is directed to an improved electrodeless lamp, and particularly to an electrodeless lamp which couples to a small bulb and obtains a relatively high light output therefrom.

While electrodeless lamps of the prior art typically use bulbs having a diameter of ¾ inch or greater, for some applications it is desirable to use a smaller bulb of diameter of about ½ inch or less. For example, one reason that such a bulb may be desirable is that it results in faster lamp starting, which may be necessary or desirable for certain applications. However, successfully coupling to a small bulb in an efficient manner presents special problems.

In co-pending application Ser. No. 211,543 assigned to the same assignee as the present invention, an electrodeless lamp for coupling to a small bulb is disclosed. In this lamp, the shape and dimensions of the resonant cavity are selected so that the microwave operating mode is such that the resulting electric field in the lamp is substantially parallel to the height dimension of the cavity, and the height is made small enough to couple strong fields to the bulb.

While successfully coupling strong fields to the bulb, the lamp of the prior application is limited in that it does not include a reflector for directing and improving the light output. In many electrodeless lamps of the prior art, for example, see U.S. Pat. Nos. 4,485,332 and 4,683,525, the major part of the microwave cavity also serves as a reflector. However, when coupling to a small bulb, it has been found that for strong coupling to the bulb to occur, the dimensions of the cavity must be so small that resonance cannot be attained at the required operating frequency with any known reflecting cavity.

In accordance with the present invention, a unique cavity is provided which overcomes this problem. The cavity is comprised of a compound resonant structure having first and second discrete portions of different cross-sectional dimensions and preferably of different cross-sectional shapes. Microwave energy is fed to the first cavity portion or vestibule, while the bulb is located in the second cavity portion, which is a reflector for reflecting light which is emitted by the bulb out of the cavity.

The dimensions of the first and second cavity portions are such that the structure as a whole is resonant, and results in an electric field which is generally parallel to the height dimension of the cavity, which is made small enough to couple strong fields to the bulb.

The cross-sectional shape of the reflector is circular, while in the preferred embodiment, the cross-sectional shape of the vestibule is rectangular, which allows microwave coupling components which can be easily fabricated to be used.

It is thus an object of the present invention to provide an improved electrodeless lamp for providing enhanced light output from a small bulb.

The invention will be better understood by referring to the accompanying drawings wherein.

FIGS. 4, 5, 6, 7, and 8 are illustrations of further embodiments of the present invention.

Figure 9:
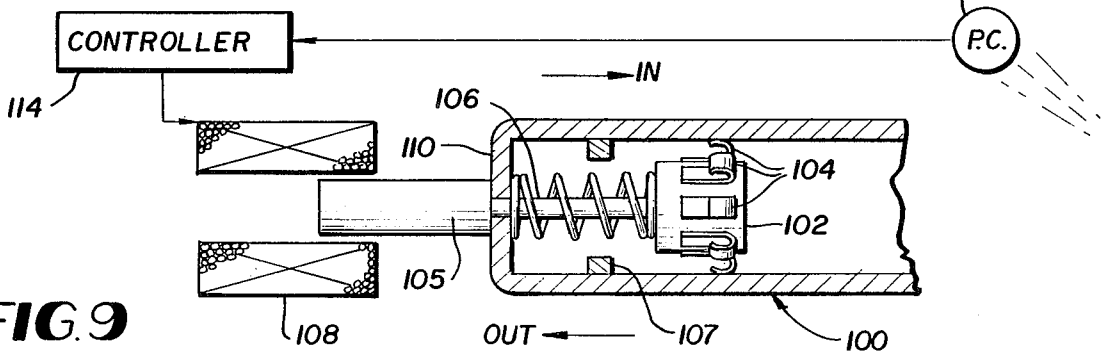

FIG. 9 is an illustration of a further embodiment of which shows automatic cavity tuning.

Figure 1:
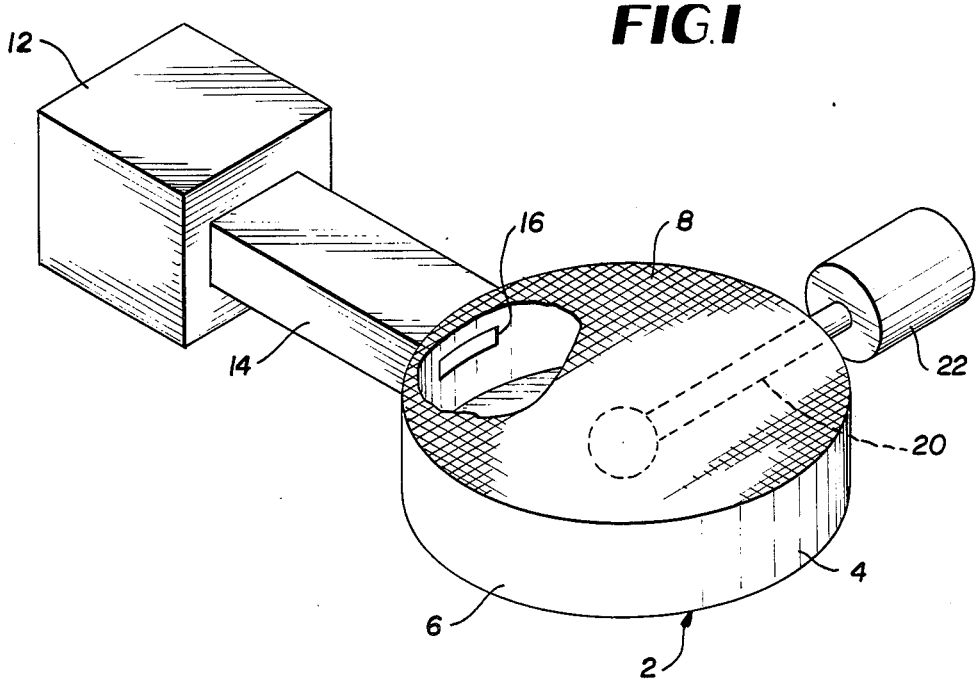
FIG. 1 shows the lamp for coupling to small bulbs disclosed in co-pending application Ser. No. 211,543.

Referring to FIG. 1, the lamp for advantageously coupling to a small bulb which is the subject of the above-mentioned prior co-pending application is shown. It is seen to be comprised of a cylindrical cavity which is comprised of cylindrical wall 4 bounded by ends 6 and 8. End 8 is a mesh or screen for retaining microwave energy in the cavity while allowing ultraviolet and visible light to escape, and the small bulb 10 is located at about the center of the cavity.

Magnetron 12 generates microwave energy, which is fed via waveguide 14 to coupling slot 16 in the cylindrical wall. Motor 22 rotates the bulb 10, which is supported by stem 20, while cooling gas (not shown) impinges on the bulb. Cavity 4 is dimensioned in relation to the frequency of microwave energy used so as to be in the $TM_{010}$ mode wherein electric field lines are parallel to the height dimension of the cavity, and the height is made small enough, about 1.06" in the illustrative embodiment to couple strong fields to the bulb, resulting in high intensity radiation being emitted therefrom. In another embodiment in the same co-pending Application, the cavity is rectangular in shape rather than circular.

As mentioned above, a drawback of the lamp shown in FIG. 1 is that it does not include a reflector. While electrodeless lamps of the prior art typically utilize cavities of various shapes which do include reflectors, such cavities may not be adapted to the present lamp since they are not resonant at the desired operating frequency of 2450 Mhz when made small enough to effectively couple to a small bulb.

In accordance with the present invention, a unique microwave cavity comprising a compound resonant structure comprised of first and second portions is provided, which effectively couples to the small bulb. The first and second portions are of different dimensions and preferably different cross-sectional shapes and the microwave energy is coupled to the first or vestibule portion, while the second portion comprises a reflector.

Figure 2:
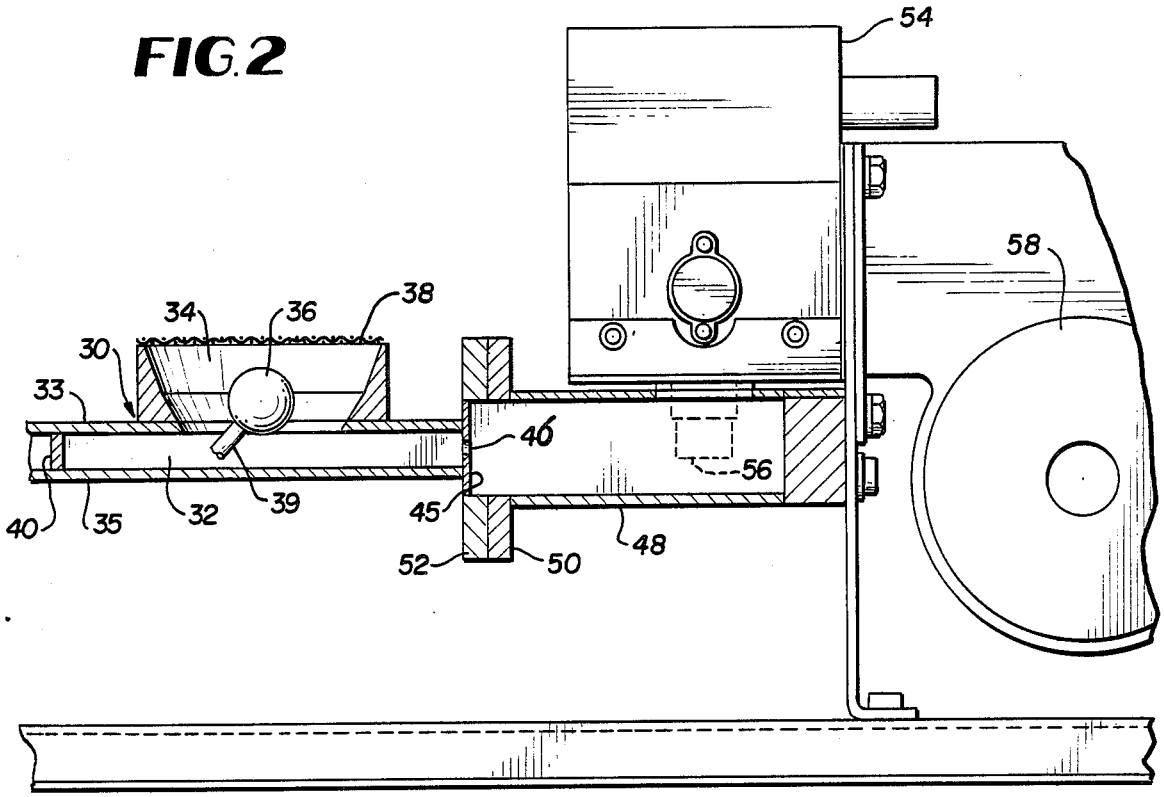
FIG. 2 is a cross-sectional view of an embodiment of the present invention.

Referring to FIG. 2, an embodiment of the present invention is shown. The electrodeless lamp depicted in FIG. 2 includes cavity 30 which is a compound resonant structure comprised of a first portion or vestibule 32 and a second portion 34 which comprises a reflector. The small bulb 36 is located substantially in reflector 34, while the microwave energy is coupled to the vestibule 32.

As can be seen, the vestibule 32 has a greater cross-sectional area than reflector 34, and there is a discontinuity in the cavity between the reflector and vestibule where the area changes. The compound structure is dimensioned so as to be resonant at 2450 Mhz, and the electric field lines are generally parallel to the height dimension of the structure, while having a somewhat flared shape near the wall of the reflector, to conform to the shape thereof.

The cross-sectional shape of the reflector 34 is circular, as is typical for reflectors, while the cross-sectional shape of the vestibule 32 is preferably rectangular, as coupling to a rectangular cavity is mechanically simpler than to a cylindrical cavity, and affords substantial savings in the fabrication of components to effect such coupling.

The mouth of reflector 34 has a screen or mesh 38 thereacross which is effective to retain microwave energy in the cavity while allowing light to exit. Additionally, the reflecting surface of the reflector may be segmented as shown in the Figure, or alternatively, may be a continuous curved surface.

Microwave energy is generated by magnetron 54 having magnetron antenna 56, and is coupled to the cavity by rectangular waveguide 48. Vestibule 32 has a coupling slot 46 in end wall 45, the long dimension of which is into the plane of the paper in the Figure, and which is effective to couple microwave energy to the cavity. The waveguide has flange 50 attached thereto, which is secured to flange 57, which is attached to vestibule 32.

The end 40 of vestibule 32 may be arranged to be adjustable in position, that is movable from right to left in the Figure, so as to change the effective length of the cavity. This is useful for tuning the lamp, as adjustments in the length of the cavity can affect performance.

Figure 3:
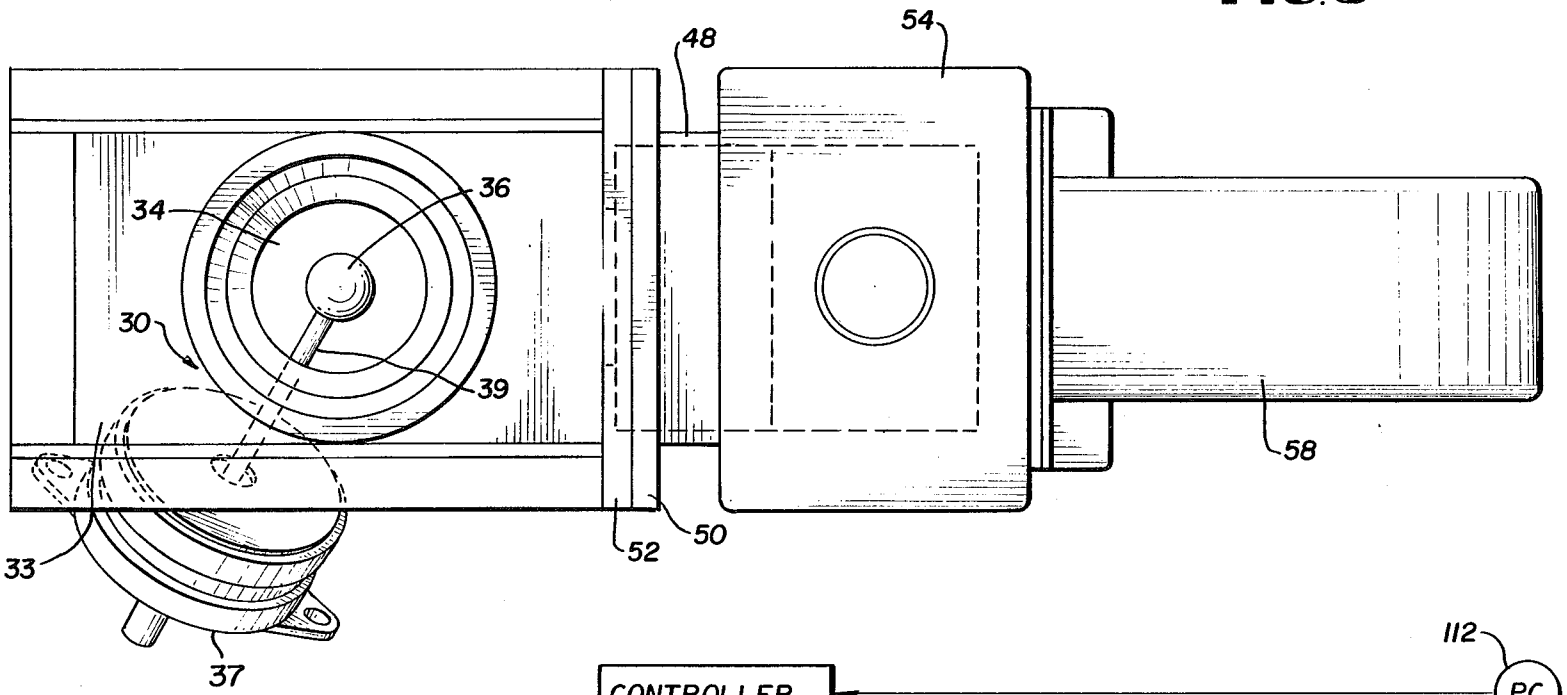
FIG. 3 is a top view of the embodiment of FIG. 2.

FIG. 3 is a top view of the embodiment of FIG. 2. As can be seen, in the illustrated embodiment, reflector 34 is centered in rectangular vestibule 32 although other dispositions may work satisfactorily. Also shown in FIG. 3 is motor 37, which is used to rotate bulb 36 via stem 39. This is to aid in the cooling of the bulb, on which streams of cooling air are impinged (not shown) while it is rotating. Bulb stem 39 is preferably located at the position of a standing wave minimum to cause minimum disruption to the electromagnetic field.

Referring to FIGS. 2 and 3, blower 58 is shown, which provides cooling to magnetron 54. If desired, an additional opening in waveguide 48 may be provided for the cooling air, which may be used to cool the waveguide and cavity.

FIGS. 4, 5, 6, 7, and 8 show further embodiments of the invention which are similar in structure to the embodiment of FIGS. 2 and 3 except for the microwave coupling structure, and wherein respective parts have been given corresponding reference numerals.

Figure 4:
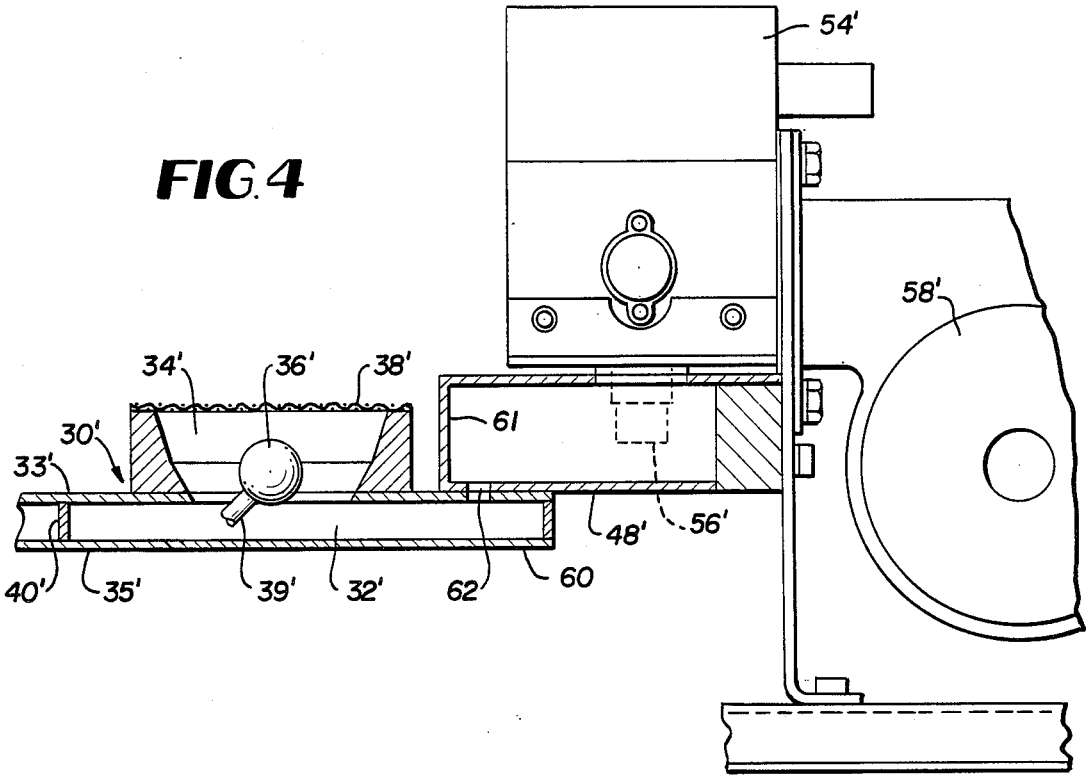

In the embodiment of FIG. 4, vestibule 32' is fed from the top instead of the end from a coupling slot in the bottom of waveguide 48', and the vestibule has end portion 60 having a slot 62 in the top thereof which runs perpendicular to the plane of the paper in the Figure.

Figure 5:
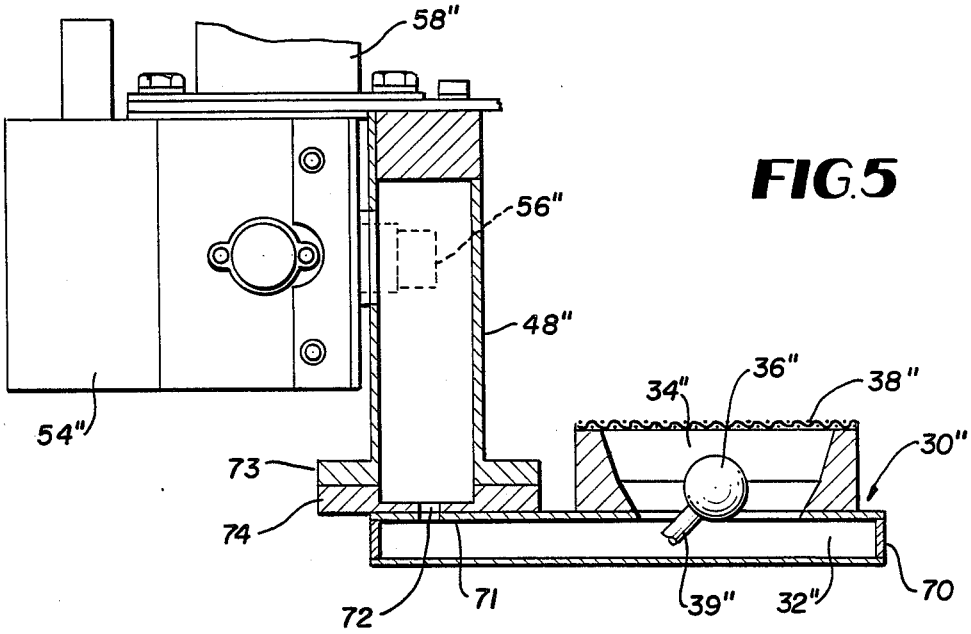
Figure 6:
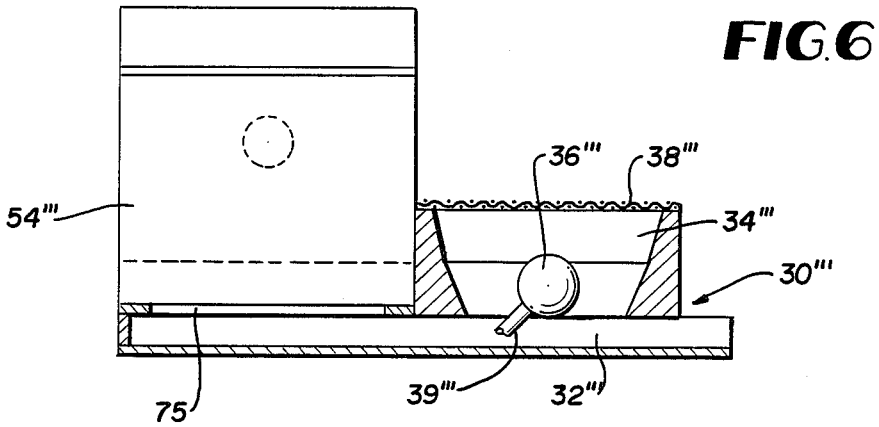
Figure 7:
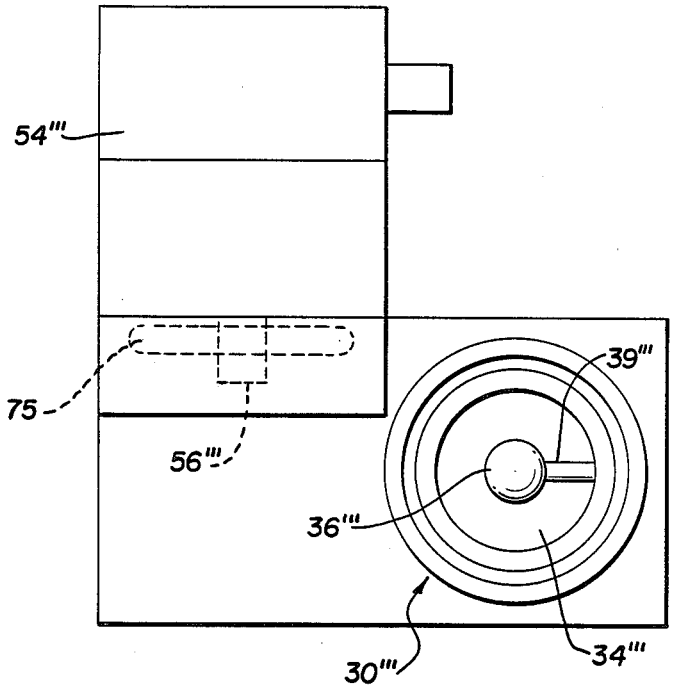

In the embodiment of FIG. 5, waveguide 48'' feeds a slot in the top of vestibule 32'' from a corresponding slot 72 in the end of the waveguide, and the long direction of the slot is again perpendicular to the plane of the paper. The embodiment of FIG. 6 is similar to that of FIG. 5, except that waveguide 48''' feeds a coupling slot 75 in the top of vestibule 32''' wherein the long direction of the slot is parallel to the long dimension of the vestibule. FIG. 7 is a top view of FIG. 6, and shows magnetron antenna 56'''.

In an alternative embodiment similar to that of FIGS. 6 and 7, the slot would be located in the side wall of the vestibule instead of in the top, and would be in the same direction as in FIGS. 6 and 7.

Figure 8:
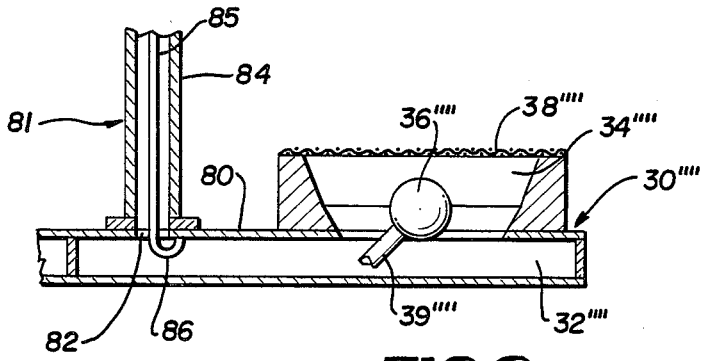

In the embodiment of FIG. 8, the microwave feed is a coaxial cable 81 rather than a waveguide. The coaxial cable is comprised of outer conductor 84 and inner conductor 85, and is terminated in coupling loop 86, which extends through slot 82 in the top of vestibule 32'''.

It should be noted that the lamp disclosed herein is a tuned structure, and that variations in the dimensions of the various parts thereof can be critical. For example, the length of vestibule 32 as well as the length of feed waveguide 48 may be critical, as may be the exact placement of reflector 34 over vestibule 32. These parameters should be optimized in each of the embodiments for individual applications.

A further aspect of the invention is illustrated in FIG. 9. It has been found that varying the length of the vestibule portion of the cavity by changing the position of the adjustable short at the cavity end between start up and steady state operating conditions can have an advantageous affect on operation.

As is known, the impedance presented by bulb in an electrodeless lamp is different at start up then it is after the bulb has ignited. To compensate for this change in load impedance, in accordance with the invention the tuning of the cavity is changed after start up so that the cavity is optimally tuned for the new load impedance.

Referring to FIG. 9, vestibule end 100 is shown having short 102 therein which is slidably supported in the vestibule by spring fingers 104. The short is attached to solenoid plunger 106, which moves the short between an inner position wherein enlarged plunger portion 105 abuts the end 110 of the vestibule and an outer position wherein the short abuts stop means 107, which is located in the vestibule.

In the operation of this aspect of the invention, activation of the solenoid coil 108 moves the solenoid plunger so as to move the short 102 between the inner and outer positions. For example, the short would be in the inner position for bulb start up, and would be moved to the outer position after the bulb has ignited. This would be accomplished by providing a photodetector 112 which detects the ignition of the lamp, and sends a signal to controller 114, which in turn activates solenoid coil 108 for moving the solenoid plunger to the outer position. Of course, in a simpler variation of this system, the photodetector would be eliminated, and the solenoid would be activated a fixed period of time after power is applied to the lamp.

In an actual embodiment of the invention in accordance with FIGS. 2 and 3 which was built, the total height of the compound resonant structure was 1.250 inches, while the height of the interior of the vestibule was 0.375 inches and the height of the interior of the reflector was 0.8 inches. Additionally, the interior length and width of the vestibule were $4\frac{1}{2}$ inches and 3 inches respectively. Further, the inner diameter of the reflector at the top was 2.5 inches and at the bottom was 1.687 inches, while the diameter of the spherical bulb used was about $\frac{1}{2}$ inch.

There thus has been disclosed an improved electrodeless lamp having a unique resonant structure. While illustrative embodiments have been disclosed, it should be appreciated that structural variations within the scope of the invention will occur to those skilled in the art. For example, while the illustrative embodiments utilize a preferred rectangular vestibule and cylindrical reflector, vestibules and reflectors of other shapes may be used.

In view of the above, it should be appreciated that while the invention has been disclosed in connection with illustrative embodiments, it is to be limited only by the claims appended hereto and equivalents.

We claim:

1. An electrodeless lamp comprising, a microwave cavity, a bulb containing a plasma forming medium in said cavity, means for generating microwave energy, and
means for coupling the generated microwave energy to said cavity,
wherein said cavity comprises a compound resonant structure having first and second discrete portions of different cross-sectional areas, there being a discontinuity in said cavity between said first and second portions where said cross-sectional area changes, said microwave energy being coupled to said first cavity portion, and said bulb being located substantially within said second cavity portion, said second cavity portion comprising a reflector for reflecting radiation emitted by said bulb out of said cavity.

2. The electrodeless lamp of claim 1 wherein said second portion of said cavity has a greater height than said first portion.

3. The electrodeless lamp of claim 2 wherein the cross-sectional area of first portion is greater than the cross-sectional area of said second portion.

4. The electrodeless lamp of claim 3 wherein said reflector has a mouth, and a mesh is disposed across the mouth.

5. The electrodeless lamp of claim 4 wherein said first and second portions of said resonant microwave structure are of different cross-sectional shapes.

6. The electrodeless lamp of claim 5 wherein the electric field in said compound resonant structure is generally parallel to its height dimension.

7. The electrodeless lamp of claim 5 wherein the cross-sectional shape of said first cavity portion is rectangular and the cross-sectional shape of said second cavity portion is circular.

8. The electrodeless lamp of claim 6 wherein the cross-sectional shape of said first cavity portion is rectangular and the cross-sectional shape of said second cavity portion is circular.

9. The electrodeless lamp of claim 7 wherein the bulb is mounted in the cavity by a stem, and the stem is disposed at the location of a standing wave minimum.

10. The electrodeless lamp of claim 7 wherein said microwave energy is coupled to an end of said rectangular portion of said resonant microwave structure.

11. The electrodeless lamp of claim 7 wherein said microwave energy is coupled to a top or bottom face of said rectangular portion of said resonant microwave structure.

12. The electrodeless lamp of claim 7 wherein said microwave energy is coupled to a side of the rectangular first portion of said resonant microwave structure.

13. The electrodeless lamp of claim 7 wherein a dimension of the rectangular first portion of said compound resonant structure is adjustable.

14. An electrodeless lamp comprising,
a microwave cavity,
a bulb containing a plasma forming medium in said cavity,
means for generating microwave energy, and
means for coupling the generated microwave energy to said cavity,
wherein said cavity comprises a compound resonant structure having first and second portions of different cross-sectional shape, said means for coupling microwave energy being arranged to couple such energy to said first portion, and said bulb being located substantially in said second portion.

15. The electrodeless lamp of claim 14 wherein said first portion of said cavity is rectangular in cross-section and said second portion is circular in cross-section.

16. The electrodeless lamp of claim 15 wherein said second portion of said cavity comprises a reflector for reflecting light emitted by said bulb out of said cavity.

17. The electrodeless lamp of claim 16 wherein said reflector has a mouth which is closed by a mesh.

18. The electrodeless lamp of claim 17 wherein said first and second cavity portions have a height dimension which is perpendicular to said cross-sectional shapes and wherein the electric field in said compound resonant structure is generally parallel to said height dimension.

19. The electrodeless lamp of claim 16 wherein said second portion of said cavity is of greater height than said first portion, and wherein said first portion has a constant cross-sectional dimension over its height while said second portion has a varying cross-sectional dimension over its height.

20. An electrodeless lamp which couples to a small bulb and achieves relatively high light output therefrom, comprising,
a microwave cavity,
a bulb containing a plasma forming medium located in said cavity,
means for generating microwave energy,
and means for coupling the generated microwave energy to said cavity,
wherein said cavity is a compound resonant structure of dimensional configuration in relation to the frequency of said microwave energy such that the electric field in the cavity is generally parallel to the height dimension thereof and wherein the height dimension is small enough so that a field of requisite strength is coupled to said bulb, and wherein said compound resonant structure is comprised of first and second discrete portions, said second portion having greater height than said first portion but said first portion having a larger cross-sectional dimension than said second portion, said microwave energy being fed to said first portion, and said bulb being located substantially in said second portion, wherein said second portion is a reflector for reflecting light emitted by said bulb out of said cavity.

21. The electrodeless lamp of claim 20 wherein the cross-sectional shape of said first portion of said compound resonant structure is rectangular and the cross-sectional shape of said second portion is circular.

22. An electrodeless lamp comprising
a microwave cavity,
a bulb containing a plasma forming medium in said cavity,
means for generating microwave energy, and
means for coupling the generated microwave energy to said cavity,
wherein said cavity comprises a compound resonant structure comprised of first and second discrete portions, said first portion having a greater cross-sectional area than said second portion, while said second portion has a greater height than said first portion, said microwave energy being coupled to said first portion, and said second portion having a cross-sectional area which varies across its height.

23. The electrodeless lamp of claim 22 wherein the cross-sectional shape of said second portion is circular while the cross-sectional shape of said first portion is rectangular.

24. The electrodeless lamp of claim 23 wherein the cross-sectional area of said first portion is substantially the same across its height.

* * * * *